US011527177B2

(12) United States Patent
Stephens et al.

(10) Patent No.: US 11,527,177 B2
(45) Date of Patent: Dec. 13, 2022

(54) TAMPER-EVIDENT TEAR AWAY FILM

(71) Applicant: D&W Fine Pack, Fort Wayne, IN (US)

(72) Inventors: Roland R. Stephens, Fort Wayne, IN (US); Scott Rhea, Fort Wayne, IN (US); Masaya Kosaka, Fort Wayne, IN (US); Hideki Yokotani, Osaka (JP); Reiichhi Konishi, Osaka (JP)

(73) Assignee: D&W Fine Pack, Fort Wayne, IN (US)

( * ) Notice: Subject to any disclaimer, the term of this patent is extended or adjusted under 35 U.S.C. 154(b) by 616 days.

(21) Appl. No.: 16/582,890

(22) Filed: Sep. 25, 2019

(65) Prior Publication Data

US 2021/0090468 A1 Mar. 25, 2021

(51) Int. Cl.
*G09F 3/00* (2006.01)
*B65D 55/06* (2006.01)

(52) U.S. Cl.
CPC ..... *G09F 3/0292* (2013.01); *B65D 55/06* (2013.01); *B65D 2401/60* (2020.05)

(58) Field of Classification Search
CPC ..... B65D 73/0028; B65D 77/2096; B65D 63/1009; B65D 55/06; B65D 2401/60; B65D 2401/00; B65D 55/026; B65D 77/2032; G09F 3/0292; G09F 3/0341
See application file for complete search history.

(56) References Cited

U.S. PATENT DOCUMENTS 4,202,464 A * 5/1980 Mohs ..... B65D 55/06 220/839
5,316,777 A * 5/1994 Toyoda ..... B32B 7/12 428/317.1
5,676,401 A * 10/1997 Witkowski ..... G09F 3/10 40/310
6,056,141 A * 5/2000 Navarini ..... B65D 77/2044 428/35.8
6,248,380 B1 * 6/2001 Kocher ..... B65D 77/2024 426/396
6,264,033 B1 7/2001 Kannabiran et al.
8,158,230 B2 4/2012 Culbertson et al.
8,746,490 B2 * 6/2014 Huffer ..... B32B 3/06 156/247
9,550,616 B2 1/2017 Hallak
9,975,680 B2 * 5/2018 Huffer ..... B65D 75/327
10,364,078 B2 * 7/2019 Huffer ..... B32B 38/105
11,225,355 B2 * 1/2022 Huffer ..... B65D 17/502
11,292,654 B2 * 4/2022 Huffer ..... B65D 77/2056
2002/0197425 A1 * 12/2002 Wolf ..... B29C 48/08 428/203

(Continued)

*Primary Examiner* — Kareen K Thomas
(74) *Attorney, Agent, or Firm* — Seyfarth Shaw LLP

(57) ABSTRACT

Tamper-evident features for containers. A tamper-evident film is target printed onto a sheet material that is thermoformable. The sheet is thermoformed into a container base or lid having a desired shape, such that the tamper-evident film is positioned in a desired area. A container lid is disposed on the container base, and heat sealed to a rim or edge of the container base. The heat sealing activates an adhesive of the tamper-evident film, and when the container lid is removed or separated from the container base, a first portion of the tamper-evident film remains on the container lid and a second portion remains on the container base. The separation of the tamper-evident film provides an indication of tampering.

16 Claims, 9 Drawing Sheets

(56) References Cited

U.S. PATENT DOCUMENTS

| | | | | |
|---|---|---|---|---|
| 2004/0016208 | A1* | 1/2004 | Mumpower | B32B 27/08 53/411 |
| 2005/0258634 | A1* | 11/2005 | Dronzek | B32B 27/36 283/72 |
| 2005/0276525 | A1* | 12/2005 | Hebert | B32B 37/1292 383/203 |
| 2007/0071968 | A1 | 3/2007 | Hermony et al. | |
| 2008/0020165 | A1* | 1/2008 | Drori | G09F 3/0292 428/40.1 |
| 2010/0043694 | A1* | 2/2010 | Patel | G09F 3/0341 156/60 |
| 2013/0020328 | A1* | 1/2013 | Duan | B65D 77/2056 220/359.3 |
| 2015/0086756 | A1* | 3/2015 | Dubey | G09F 3/10 156/60 |
| 2016/0314721 | A1* | 10/2016 | Hasegawa | G09F 3/0292 |

* cited by examiner

TAMPER-EVIDENT TEAR AWAY FILM

TECHNICAL FIELD OF THE INVENTION

The present invention relates to tamper-evident containers. More particularly, the present invention relates to a tamper-evident film that provides a visual indication of tampering.

BACKGROUND OF THE INVENTION

Plastic containers are a well-known form of housing objects, especially perishable foods that can spoil. Such containers come in different shapes and sizes, and can store consumable items such as fruits, vegetables, or other food items.

Containers for storing food items can have tamper-evident qualities such that the container visually depicts whether the container was previously opened, thus providing an indication that the contents were tampered with. In this manner, a buyer can be assured that the container has not been opened, and that the contents of the container have not been altered since the container was initially closed.

SUMMARY OF THE INVENTION

The present application relates to tamper-evident features for containers. A tamper-evident film is target printed onto a sheet material that is thermoformable. The sheet is thermoformed into a container base or lid having a desired shape, such that the tamper-evident film is positioned in a desired area. A container lid is disposed on the container base, and heat sealed to a rim or edge of the container base. The heat sealing activates an adhesive of the tamper-evident film, and when the container lid is removed or separated from the container base, a first portion of the tamper-evident film remains on the container lid and a second portion remains on the container base. The separation of the tamper-evident film provides an indication of tampering.

For example, the present application discloses a container that includes a base adapted to hold an item, and a lid adapted to couple to the base and close the base. A tamper-evident layer is disposed between the base and the lid. The tamper-evident layer includes a target printed release layer with areas of non-coverage that form a temper-evident message when the lid is separated from the base, a target printed ink layer disposed over the release layer and filling the areas of non-coverage, and a heat seal layer disposed over the ink layer.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION OF THE EMBODIMENTS

Figure 1:
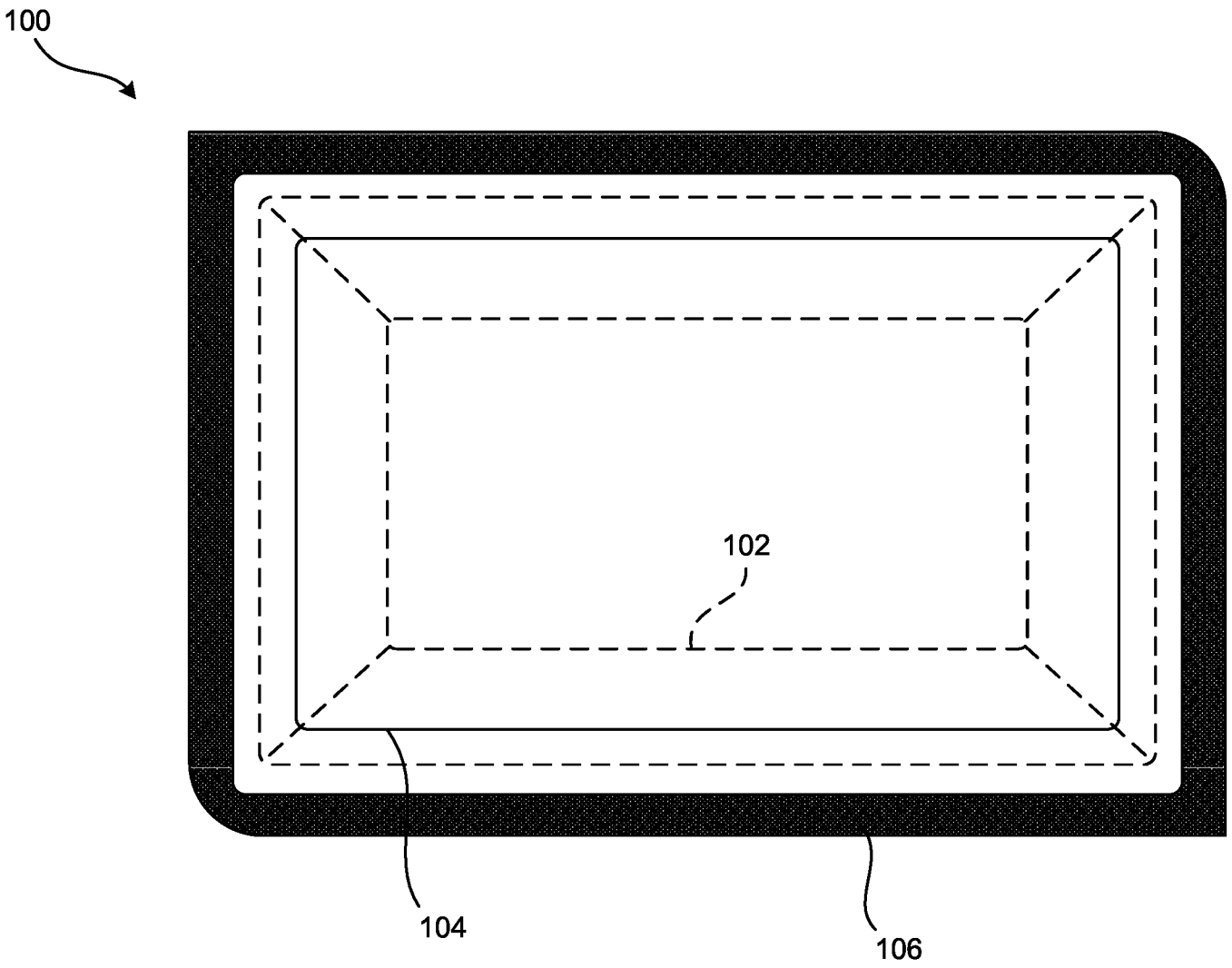
FIG. 1 is a top view of a tamper-evident container according to an embodiment of the invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present application relates to tamper-evident features for containers. A tamper-evident film is target printed onto a sheet material that is thermoformable. The sheet is thermoformed into a container base or lid having a desired shape, such that the tamper-evident film is positioned in a desired area. A container lid is disposed on the container base, and heat sealed to a rim or edge of the container base. The heat sealing activates an adhesive of the tamper-evident film, and when the container lid is removed or separated from the container base, a first portion of the tamper-evident film remains on the container lid and a second portion remains on the container base. The separation of the tamper-evident film provides an indication of tampering.

Referring to FIG. 1, a container 100 is shown having a container base 102 adapted to receive and hold one or more items, and a container lid 104 adapted to be releasably coupled to and close and opening of the base 102. A tamper-evident film or layer 106 is disposed between the lid 104 and base 102. As illustrated, the tamper-evident layer is disposed around a perimeter flange area of the lid 104 and base 102. This perimeter flange area may include mating features on the lid 104 and base 102 that allow the container to be opened and closed.

In an exemplary illustration, the container 100 shown in FIG. 1 has not been opened or otherwise tampered with, wherein the lid 104 is releasably coupled to the base 102, and the tamper-evident layer 106 is has not been activated or opened. As described in further detail below, the temper-evident layer may include multiple component layers. For example, a release layer, an ink layer, and a heat sealant adhesive layer. These release layer is designed to allow portions of the ink layer to separate and reveal a message (such as "TAMPERED") when the lid 104 is opened, removed, or otherwise separated from the base 102. In an example, the when the lid 104 is removed, ink printed in the form of the message (i.e., "TAMPERED") remains coupled to the lid 104, and the ink surrounding the message remains on the base 102. Thus, when the message is visible to a user or consumer, the consumer is notified that the container 100 has been opened or otherwise tampered with.

The tamper-evident layer 106 may be target printed to be on the perimeter flange of the container 100, and the ink and release layers may be target printed to reveal a message (such as "TAMPERED"). However, the tamper-evident layer 106 may be target printed on other areas of coupling and de-coupling of container portions, and the message may be any word, phrase, symbol, etc.

Figure 2:
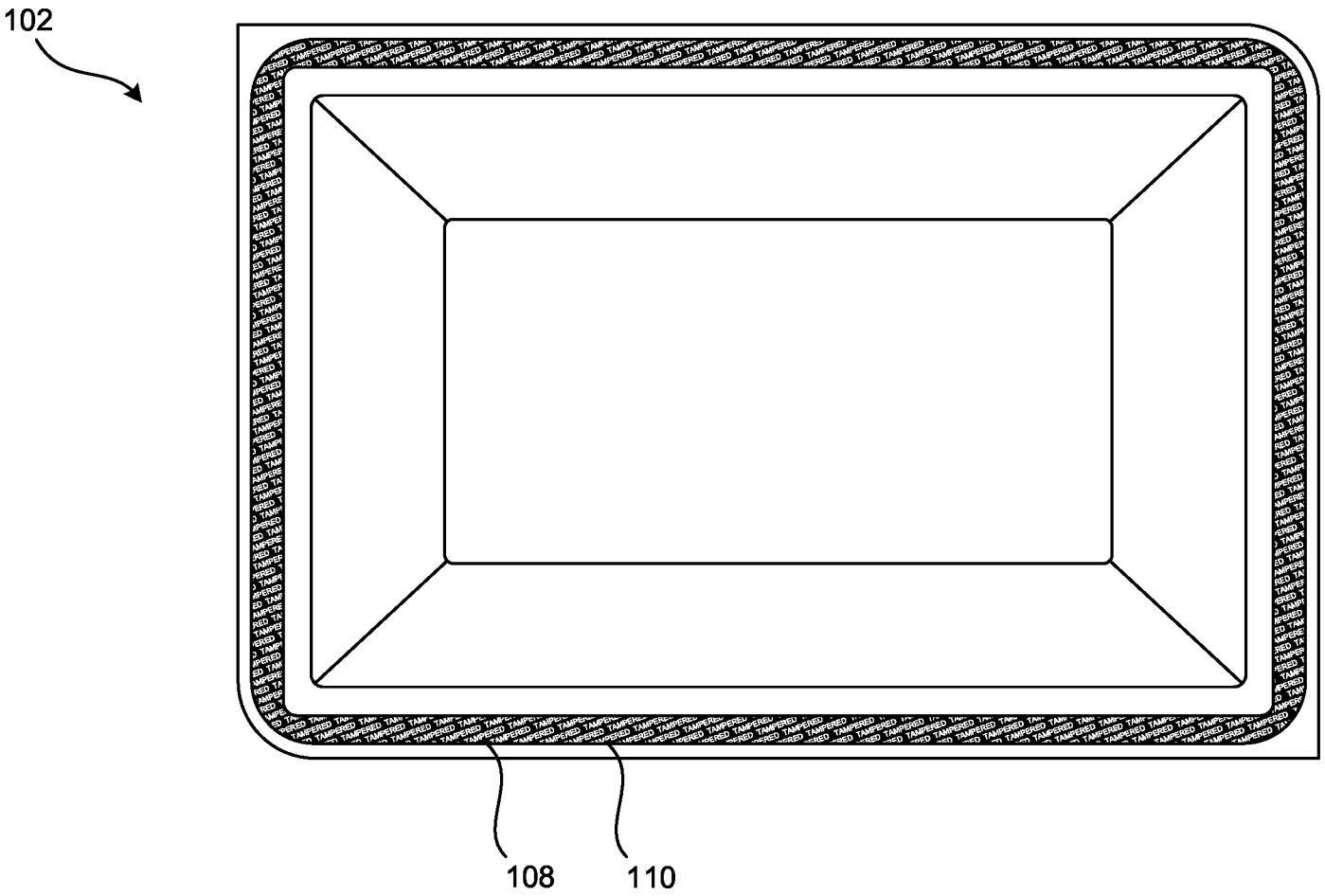
FIG. 2 is a top view of a container base of the tamper-evident container of FIG. 1 with a container lid removed.
Figure 3:
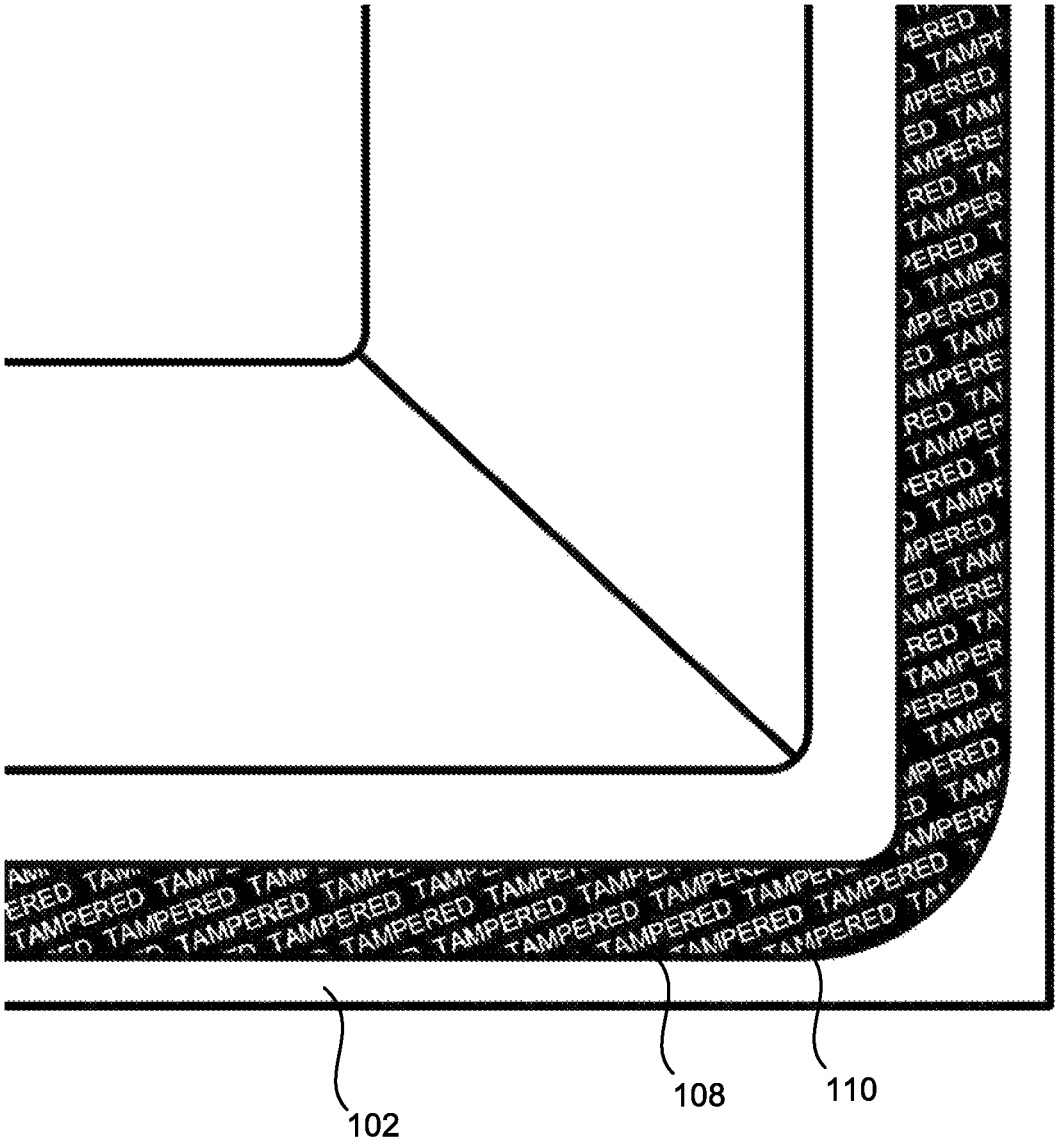
FIG. 3 is an enlarged view of a corner of the container base of FIG. 2.
Figure 4:
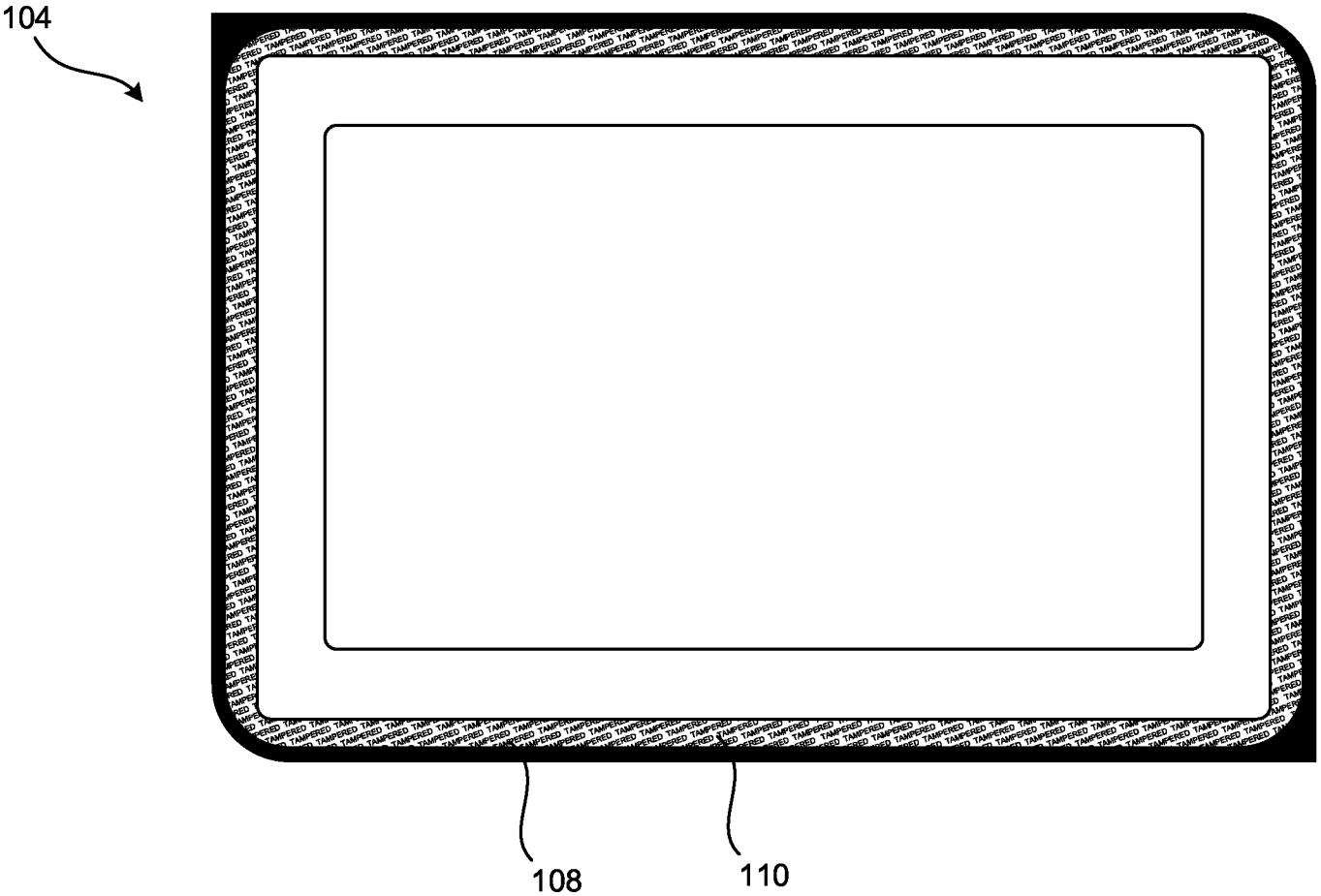
FIG. 4 is a bottom view of the container lid of the tamper-evident container of FIG. 1 with the lid removed from the container base.
Figure 5:
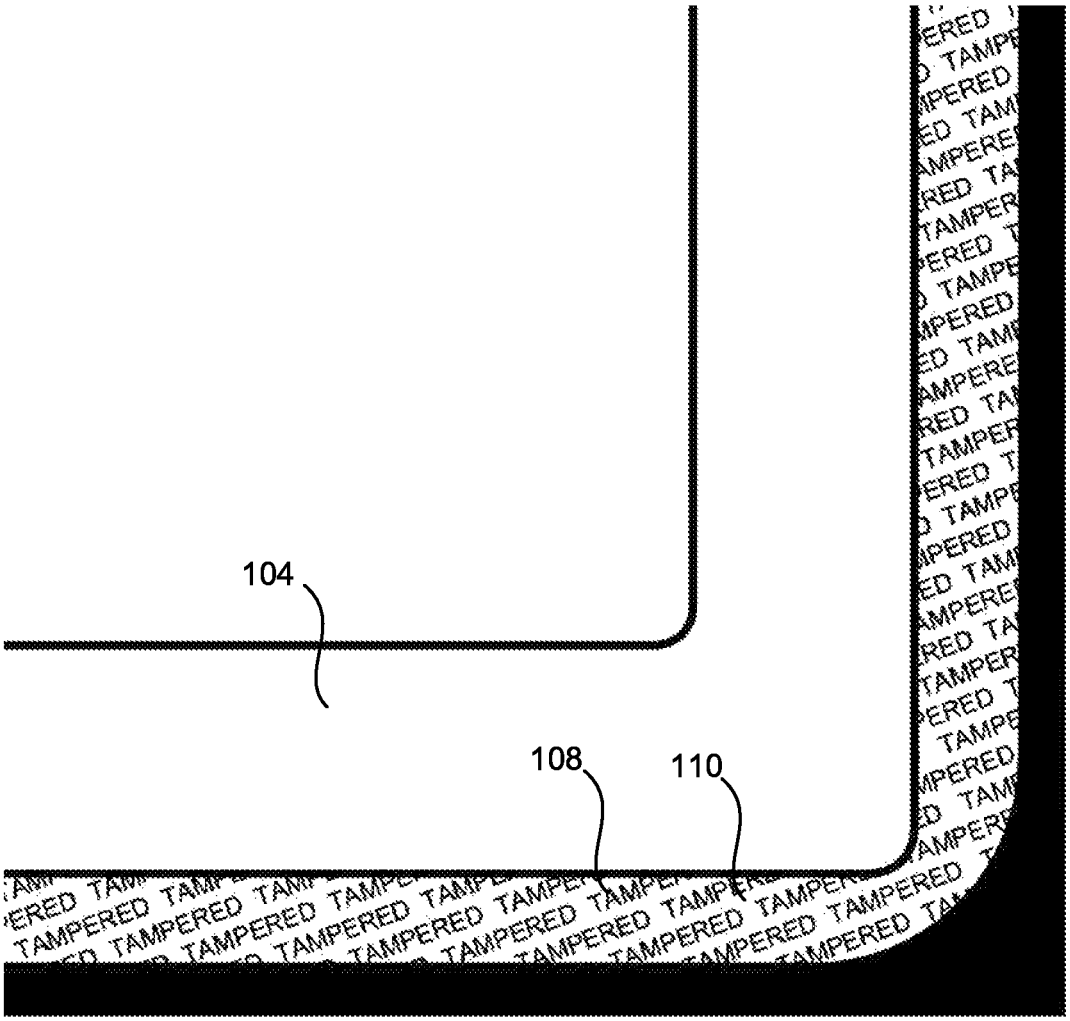
FIG. 5 is an enlarged view of a corner of the container lid of FIG. 4.

Referring to FIGS. 2 and 3, the container base 102 is shown separated from the lid 104. As illustrated, an ink layer 108 (shown in black) remains coupled to the base 102, and a non-ink portion 110 provides the message. Conversely, referring to FIGS. 3 and 4, the container lid 104 is shown separated from the base 102. As illustrated, the ink layer 108 (shown in black) remains coupled to the lid 104 and provides the message.

Figure 6:
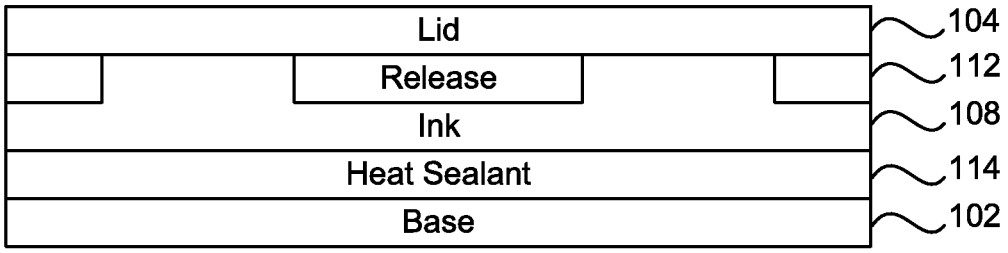
FIG. 6 is a diagram of a tamper-evident film in an untampered state according to an embodiment of the invention.

Referring to FIG. 6, a conceptual layer diagram of the container 100 and tamper-evident layer 106 is shown in an untampered state. For example, a release layer 112 may be coupled to or printed onto the lid 104, with gaps or areas of non-coverage that provide the message. The release layer 112 may be a resin (such as an acrylic/polyethylene), solvent-based (toluene/MEK) material, or other suitable material(s).

The ink 108 is printed over the release layer 112, and fills the areas of non-coverage. This causes the message to be invisible or otherwise not visible, until the container 100 is opened or otherwise tampered with. The ink layer 108 may be a pigment, resin (such as vinyl chloride-vinyl acetate/polyester polyol, solvent based (vinegar ethyl/MEK/toluene)) material, or other suitable material(s). The pigment may be any color, including but not limited to, white, black, green red, orange, brown, blue, etc.

A heat sealant layer 114 is printed or otherwise disposed over the ink layer 108. The heat sealant layer 114 is heat sealed or otherwise coupled to the base 102.

Figure 7:
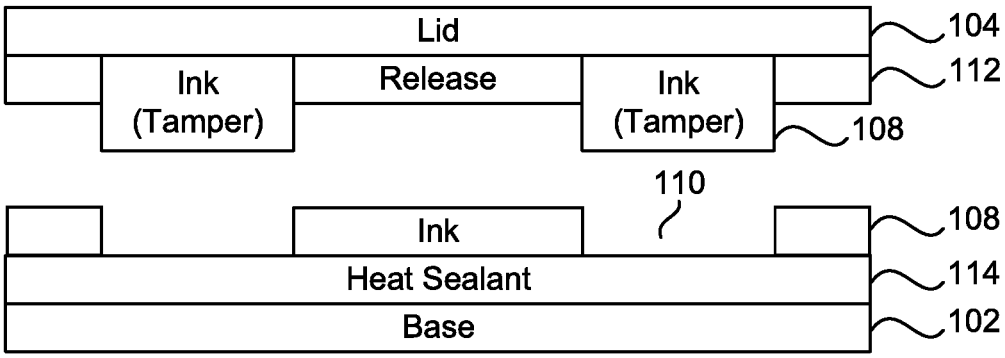
FIG. 7 is a diagram of the tamper-evident film of FIG. 6 in a tampered state.

Referring to FIG. 7, a conceptual layer diagram of the container 100 and tamper-evident layer 106 is shown in a tampered state. For example, the release layer 112 remains coupled to or printed onto the lid 104, and the ink layer 108 is separated with portions of the ink layer 108 that remain coupled to the lid 104 in the areas of non-coverage to provide the message. The remaining portions of the ink layer 108 remain coupled to the heat sealant layer 114/base 102, with areas of non-ink. These areas of non-ink may also provide the message, just in a different form. For example, if the ink layer 108 is white, the message may be displayed as white on the lid 102, and clear on the base 102.

While the release layer 112 is described as coupled to the lid 104 and the heat sealant layer 114 is described as coupled to the base 102, the release layer 112 may be coupled to the base 102 and the heat sealant layer 114 may be coupled to the lid 104.

Figure 8:
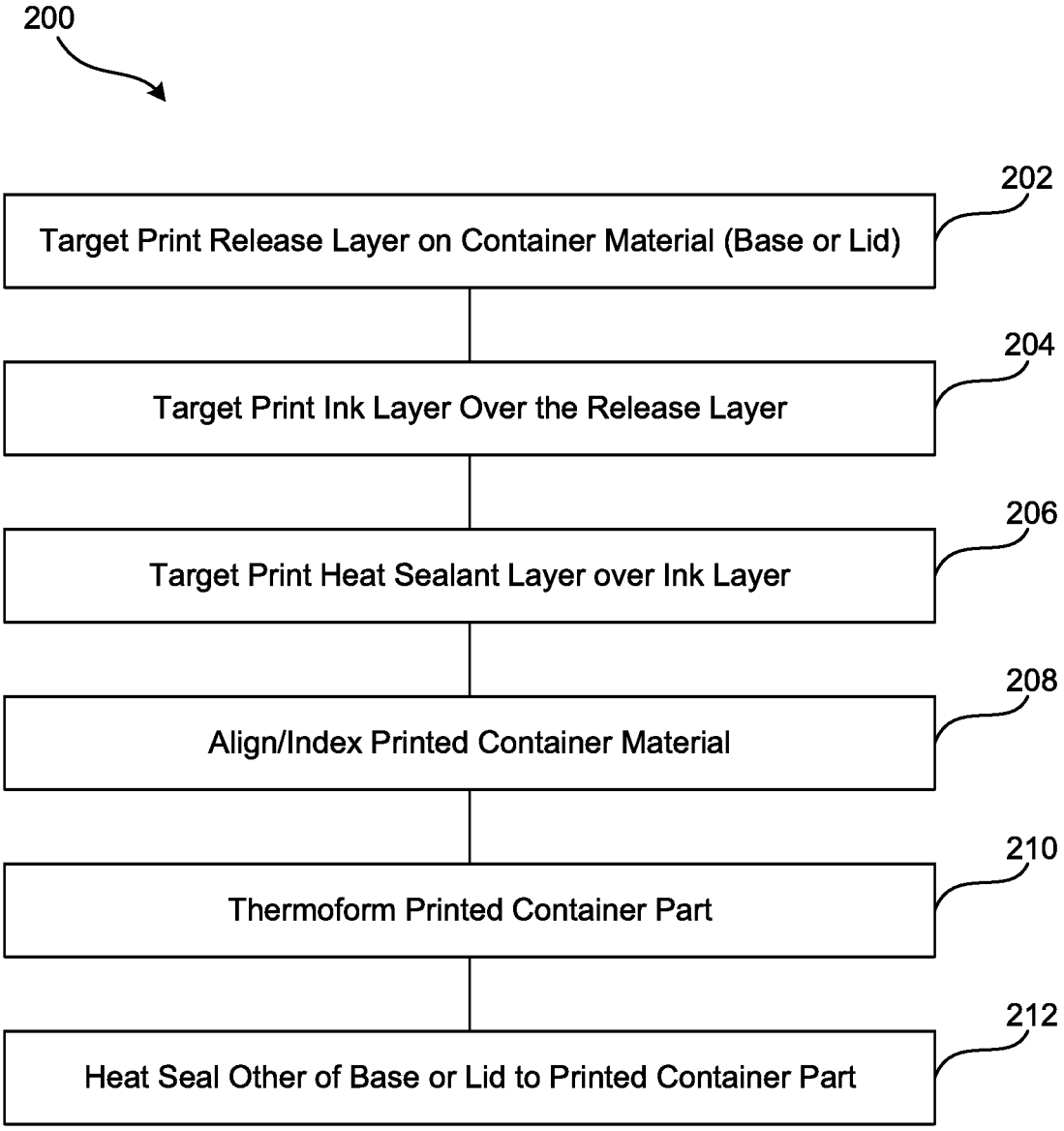
FIG. 8 is a block diagram of a method of making a container including a tamper-evident film according to an embodiment of the invention.

An exemplary method 200 of manufacturing or making a container with the tamper-evident layer is described with reference to FIG. 8. In block 202, the release layer is target printed on a sheet of container material (which could be either the base or the lid). As mentioned above, the release layer may include gaps or areas of non-coverage that provide the temper-evident message. When the release layer is printed, care should be taken to print the release layer to be correctly placed on the perimeter flange of the container, in the example described herein. Additionally, the release layer should be even, embossed and close to transparent.

The ink layer is target printed over the release layer, illustrated as block 204. The ink layer fills the areas of non-coverage in order to allow the ink layer to separate and provide the tamper-evident message. When the ink layer is printed, care should be taken to print the ink layer so the message is not visible prior to tampering and the message is clear. Additionally, the ink layer is target printed to be correctly placed on the perimeter flange of the container, in the example described herein.

Heat sealant adhesive is disposed on or printed over the ink layer, illustrated as block 206. The printed container material is aligned or indexed to ensure the printed area is positioned in a desired area of the final container, illustrated as block 208. For example, the printed container material may be aligned or indexed to be located around a perimeter flange of a container. The printed container material is thermoformed into a container part (which could be either the base or the lid), illustrated as block 210. The other of the base or the lid is thermoformed and heat sealed to the container part to create the sealed container, illustrated as block 212. It should be appreciated that the container may be filled with food, other perishables, or non-perishable items or material prior to the container being sealed.

Once the container is opened and the tamper-evident message is activated or visible, the lid and base can be re-coupled together. However, the tamper-evident message or part thereof will still be visible to notify a consumer that the container has been opened or otherwise tampered with. This is because it would be very difficult for a person to exactly realign the separated ink layers back together.

In another embodiment, the ink layer 108 may be coupled to or printed onto the lid 104. For example, referring to FIG. 9, a conceptual layer diagram of the container 100 and tamper-evident layer 106 is shown in an untampered state. For example, the ink layer 108 may be coupled to or printed onto the lid 104, with gaps or areas of reduced coverage or thickness that provide the message. As described above, the ink layer 108 may be a pigment, resin (such as vinyl chloride-vinyl acetate/polyester polyol, solvent based (vinegar ethyl/MEK/toluene)) material, or other suitable material(s). The pigment may be any color, including but not limited to, white, black, green red, orange, brown, blue, etc.

The release layer 112 is printed over the ink layer 108, and fills the areas of reduced coverage or thickness. This causes the message to be invisible or otherwise not visible, until the container 100 is opened or otherwise tampered with. The release layer 112 may be a resin (such as an acrylic/polyethylene), solvent-based (toluene/MEK) material, or other suitable material(s).

A heat sealant layer 114 is printed or otherwise disposed over the release layer 112 and exposed areas of the ink layer 108. The heat sealant layer 114 is heat sealed or otherwise coupled to the base 102.

Referring to FIG. 7, a conceptual layer diagram of the container 100 and tamper-evident layer 106 is shown in a tampered state. For example, the release layer 112 remains coupled to the heat sealant layer 114, and the ink layer 108 is separated with portions of the ink layer 108 that remain coupled to the lid 104, and portions of the ink layer 108 coupled to the heat sealant layer 114 in the areas where the release layer 112 is absent to provide the message.

While the ink layer 108 is described as coupled to the lid 104 and the heat sealant layer 114 is described as coupled to the base 102, the ink layer 108 may be coupled to the base 102 and the heat sealant layer 114 may be coupled to the lid 104.

Figure 9:
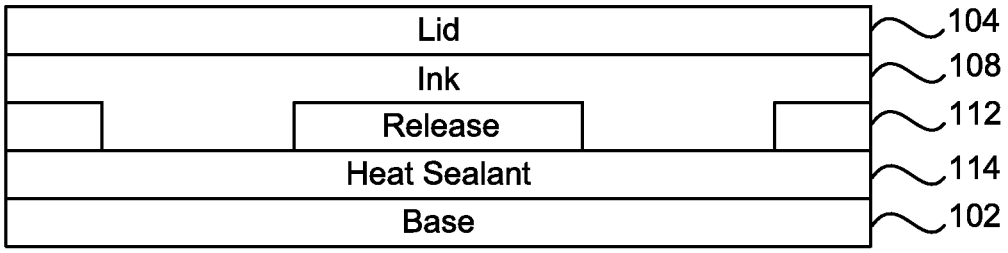
FIG. 9 is a diagram of a tamper-evident film in an untampered state according to another embodiment of the invention.
Figure 10:
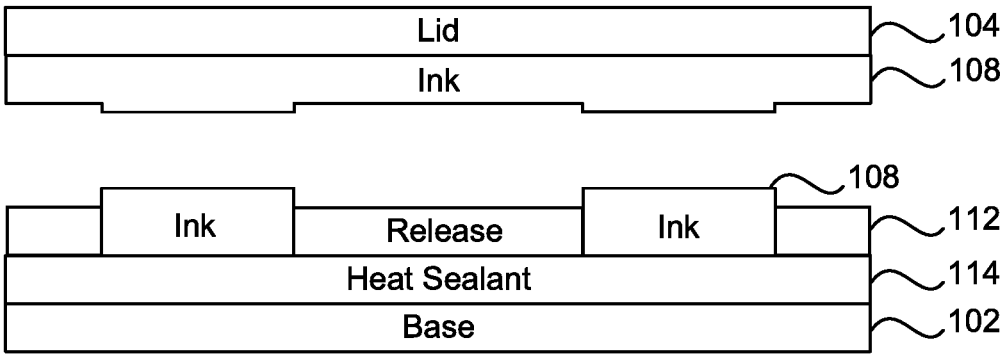
FIG. 10 is a diagram of the tamper-evident film of FIG. 9 in a tampered state.
Figure 11:
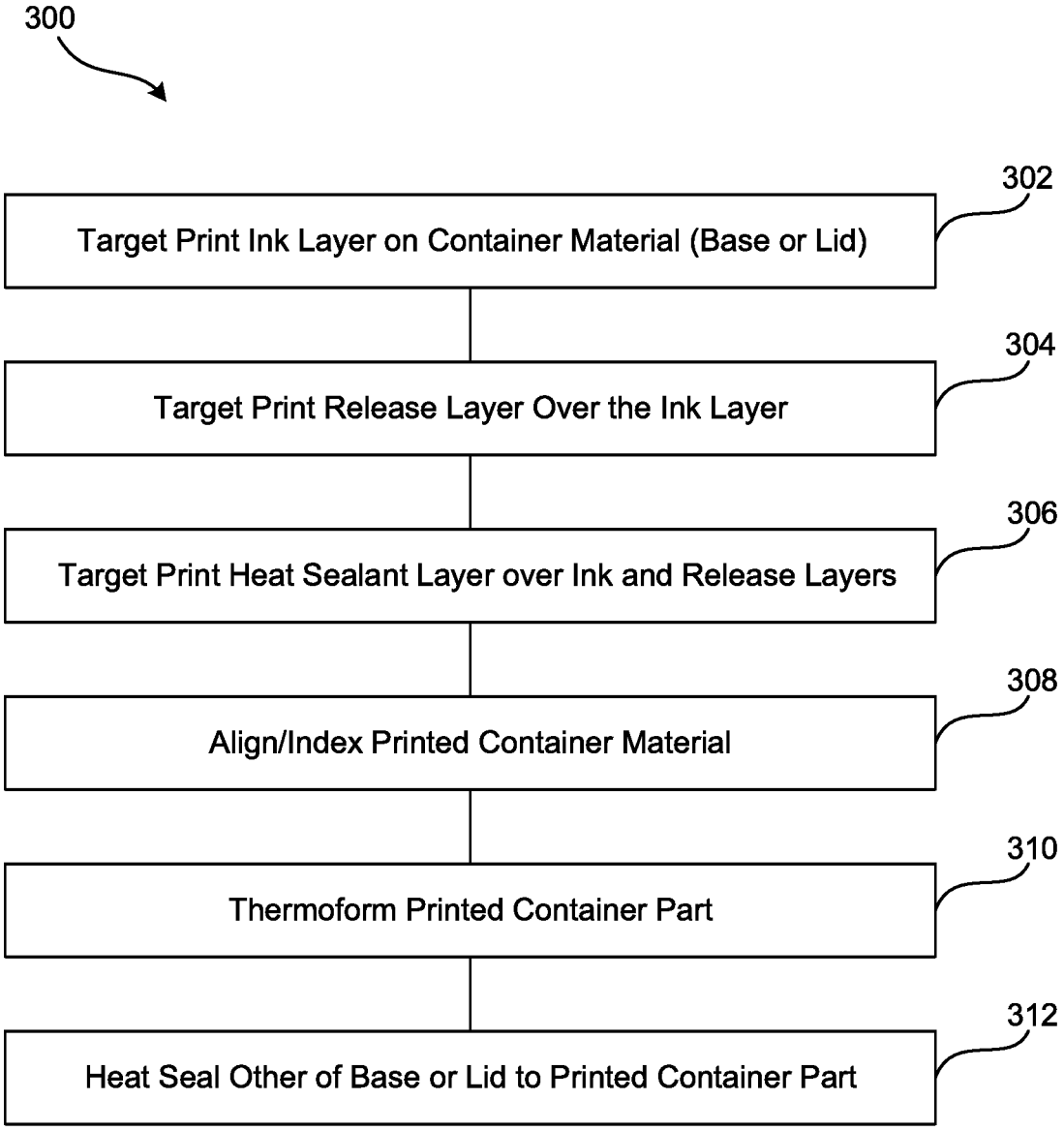
FIG. 11 is a block diagram of a method of making a container including a tamper-evident film according to another embodiment of the invention.

Another exemplary method 300 of manufacturing or making a container with the tamper-evident layer is described with reference to FIG. 9. In block 302, the ink layer is target printed on a sheet of container material (which could be either the base or the lid). As mentioned above, the ink layer may include gaps or areas of reduced coverage that provide the temper-evident message. When the ink layer is printed, care should be taken to print the ink layer to be correctly placed on the perimeter flange of the container, in the example described herein.

The release layer is target printed over the ink layer, illustrated as block 304. The release layer fills the areas of reduced coverage in order to allow the ink layer to separate and provide the tamper-evident message. When the release layer is printed, care should be taken to print the release layer so the message is not visible prior to tampering and the message is clear. Additionally, the release layer is target printed to be correctly placed on the perimeter flange of the container, in the examples described herein.

Heat sealant adhesive is disposed on or printed over the ink/release layers, illustrated as block 306. The printed container material is aligned or indexed to ensure the printed area is positioned in a desired area of the final container, illustrated as block 308. For example, the printed container material may be aligned or indexed to be located around a perimeter flange of a container. The printed container material is thermoformed into a container part (which could be either the base or the lid), illustrated as block 310. The other of the base or the lid is thermoformed and heat sealed to the container part to create the sealed container, illustrated as block 312. It should be appreciated that the container may be filled with food, other perishables, or non-perishable items or material prior to the container being sealed.

As described above, once the container is opened and the tamper-evident message is activated or visible, the lid and base can be re-coupled together. However, the tamper-evident message or part thereof will still be visible to notify a consumer that the container has been opened or otherwise tampered with. This is because it would be very difficult for a person to exactly realign the separated ink layers back together.

While the present invention is described as being a container for food or other perishable items, it will be appreciated that the container and tamper-evident features of the present invention can be used to store any type of item without departing from the spirit and scope of the present application.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A container, comprising:
a base adapted to hold an item;
a lid adapted to couple to the base and close the base;
a tamper-evident layer disposed between the base and the lid, the tamper-evident layer including:
a release layer with areas of non-coverage;
an ink layer disposed over the release layer and filling the areas of non-coverage; and
a heat seal layer disposed over the ink layer,
wherein when the lid is separated from the base, portions of the ink layer separate from the heat seal layer and remain in the areas of non-coverage to form a visible tamper-evident indication.

2. The container of claim 1, wherein the release layer is target printed on a perimeter flange area of the lid.

3. The container of claim 2, wherein the ink layer is target printed over the release layer.

4. The container of claim 3, wherein the base is heat sealed to the lid via the heat seal layer.

5. The container of claim 4, wherein the visible tamper-evident indication includes a message stating "TAMPERED".

6. The container of claim 1, wherein the release layer is target printed on a perimeter flange area of the base.

7. The container of claim 6, wherein the ink layer is target printed over the release layer.

8. The container of claim 7, wherein the lid is heat sealed to the base via the heat seal layer.

9. A container having a base that is adapted to hold contents and a lid adapted to couple to the base and enclose the contents in the base, the container comprising:
a tamper-evident layer disposed between the base and the lid, the tamper-evident layer including:
a release layer with areas of reduced coverage;
an ink layer disposed over the release layer and filling the areas of reduced coverage; and
a heat seal layer disposed over the ink layer,
wherein when the lid is separated from the base, portions of the ink layer separate from the heat seal layer and remain in the areas of non-coverage to form a visible tamper-evident indication.

10. The container of claim 9, wherein the release layer is target printed on a perimeter flange area of the lid.

11. The container of claim 10, wherein the ink layer is target printed over the release layer.

12. The container of claim 11, wherein the base is heat sealed to the lid via the heat seal layer.

13. The container of claim 12, wherein the visible tamper-evident indication includes a message stating "TAMPERED".

14. The container of claim 9, wherein the release layer is target printed on a perimeter flange area of the base.

15. The container of claim 14, wherein the ink layer is target printed over the release layer.

16. The container of claim 15 wherein the lid is heat sealed to the base via the heat seal layer.

* * * * *